US008960476B2

(12) United States Patent
Nurse, Sr.

(10) Patent No.: US 8,960,476 B2
(45) Date of Patent: Feb. 24, 2015

(54) GERM FREE BEVERAGE LID SYSTEM

(71) Applicant: Adrian Nurse, Sr., Brooklyn, NY (US)

(72) Inventor: Adrian Nurse, Sr., Brooklyn, NY (US)

( * ) Notice: Subject to any disclaimer, the term of this patent is extended or adjusted under 35 U.S.C. 154(b) by 0 days.

(21) Appl. No.: 13/852,975

(22) Filed: Mar. 28, 2013

(65) Prior Publication Data

US 2014/0151383 A1 Jun. 5, 2014

Related U.S. Application Data

(60) Provisional application No. 61/639,316, filed on Apr. 27, 2012.

(51) Int. Cl.
*B65D 17/34* (2006.01)
*B65D 51/18* (2006.01)

(52) U.S. Cl.
CPC ..... *B65D 51/18* (2013.01)
USPC ..... 220/359.2; 220/257.1; 220/716; 220/254.1

(58) Field of Classification Search
CPC ..... B65D 2251/0003; B65D 2251/0031; B65D 2251/0068; B65D 2251/0093; B65D 253/00092; B65D 253/00027; B65D 51/18; A47G 19/2227; A47G 19/2266; A47G 19/2211
USPC ..... 220/711, 703, 257, 713, 256.1, 257.1, 220/359.2, 716, 718, 256, 254.1, 254, 255, 220/257.2
See application file for complete search history.

(56) References Cited

U.S. PATENT DOCUMENTS

| | | | | |
|---|---|---|---|---|
| 4,020,969 | A * | 5/1977 | Ando | 220/359.2 |
| 5,692,616 | A | 12/1997 | Baker | |
| 5,984,135 | A * | 11/1999 | Brown | 220/708 |
| 6,311,860 | B1 * | 11/2001 | Reidinger et al. | 220/521 |
| 6,889,832 | B2 | 5/2005 | Gabele | |
| 7,195,130 | B2 * | 3/2007 | Pendergrass et al. | 220/254.1 |
| 8,167,162 | B2 * | 5/2012 | Levey | 220/359.2 |
| 8,459,491 | B2 * | 6/2013 | Savenok | 220/592.17 |
| 2004/0022674 | A1 | 2/2004 | Thurk et al. | |
| 2006/0289542 | A1 * | 12/2006 | Schedl et al. | 220/359.2 |
| 2009/0223981 | A1 * | 9/2009 | Levey | 220/712 |
| 2009/0283536 | A1 * | 11/2009 | Libby | 220/713 |
| 2013/0306663 | A1 * | 11/2013 | Stuchell et al. | 220/711 |

* cited by examiner

*Primary Examiner* — Robert J Hicks
*Assistant Examiner* — Kareen Rush
(74) *Attorney, Agent, or Firm* — Miltons IP/p.i.

(57) ABSTRACT

A germ-free beverage lid system; a protective covering specially designed for the plastic lids that are used for beverages sold in coffee house chains, fast food restaurants, convenience stores, and similar outlets. The intent is to provide a more hygienic means of offering these type of lids to consumers, helping to create a sterile cup lid to stop the spread of germs and bacteria.

17 Claims, 4 Drawing Sheets

GERM FREE BEVERAGE LID SYSTEM

CROSS-REFERENCE TO RELATED APPLICATION

The present application is related to and claims priority from prior provisional application Ser. No. 61/639,316, filed Apr. 27, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of beverage cup lids and more specifically relates to a germ-free beverage lid system.

DESCRIPTION OF THE RELATED ART

Many individuals drink beverages from cans, bottles or other similar containers. While many may grab a canned or bottled drink, a lot of people prefer a cup of fresh brewed coffee or the syrupy sweetness of a fountain soda. Today, these types of beverages in many establishments are largely self-serve: you get your own cup from a dispenser, fill it with a drink of choice, and grab a lid to secure the contents. Although convenient, such drink stations, used by so many people during the course of the day, can harbor germs and bacteria. The lids, especially, are continuously exposed; left completely uncovered unlike cups, the plastic lids are susceptible to all manners of swirling contaminants, whether dust, dirt, or even sneezes. Furthermore, as many hands are reaching for these lids every day, there is no telling what kinds of germs and sickness may be left behind on these lids. Even the lids kept behind service counters are not completely safe, since cashiers and baristas are not able to wash their hands after every cash transaction. It is desirable to have clean, germ-free lids for covering beverage cups.

Various attempts have been made to solve the above-mentioned problems such as those found in U.S. Pat. No. 5,692,616 to Baker; U.S. Pat. No. 6,889,832 to Gabele; and U.S. Pub. No. 2004/0022674 to Thurk et al. This prior art is representative of beverage lids. None of the above inventions and patents, taken either singly or in combination, is seen to describe the invention as claimed.

Ideally, a germ-free beverage lid system should provide a germ-free drinking cup lid and, yet would operate reliably and be manufactured at a modest expense. Thus, a need exists for a reliable germ-free beverage lid system to provide drinking cup lids with a germ-free drinking surface to avoid the above-mentioned problems.

BRIEF SUMMARY OF THE INVENTION

In view of the foregoing disadvantages inherent in the known beverage cup lids art, the present invention provides a novel germ-free beverage lid system. The general purpose of the present invention, which will be described subsequently in greater detail, is to provide a germ-free lid for a disposable cup.

A germ-free beverage lid system is disclosed in a preferred embodiment comprising: a cup lid assembly having a cup lid to frictionally and sealably fit about a circumference of a drinking edge of a disposable cup, and a detachable germ-free cover for uncoupling from the cup lid.

The cup lid comprises in combination a lid-body, a bottom circumferential edge located on the lid-body with the bottom circumferential edge defining the outer limits of a bottom surface of the cup lid located adjacent the disposable cup when coupled thereto. The cup lid further comprises a top circumferential edge located on a top surface of the cup lid and a distance apart from the bottom circumferential edge, and a lid opening allowing for drinking the contents of the disposable cup to occur. The lid opening traverses the bottom surface and the top surface of the cup lid with the top surface providing a drinking access for a consumer to drink the contents of the disposable cup therefrom.

The cup lid is circular to fit onto the drinking edge of a disposable cup and provides a mouth contoured surface comprised of BPA-free plastic to help contain the contents of the disposable cup. The detachable germ-free cover comprises in combination a pliable surface to cover the top surface of the lid-body of the cup lid, an attaching edge removably attached to the top circumferential edge of the cup lid, and a pull tab. The detachable germ-free cover of the cup lid assembly is preferably removably attached to the cup lid via pressure when manufactured. The detachable germ-free cover covers the lid opening of the cup lid maintaining a sterile environment for the cup lid creating a closed and evacuated zone to prevent germs from entering the contents of the disposable cup until after the detachable germ-free cover is removed from the cup lid. To help keep contents of the disposable cup at a desired temperature the evacuated zone resists heat transfer through the lid into the ambient environment. The detachable germ-free cover comprises a thin profile to provide pliability and flexibility when 'peeling back' and removing the detachable germ-free cover from the cup lid. This peeling motion is accomplished by using a lifting force and a pulling force imparted thereon to remove the detachable germ-free cover from the top circumferential edge of the cup lid. The detachable germ-free cover covers the lid opening of the cup lid to prevent germs from entering the contents of the disposable cup until after the detachable germ-free cover is removed from the cup lid.

Prior to use, the cup lid assembly is stackable such that it is convenient for use by retail venders, hospitals and consumers at self-serve locations providing hot and cold beverages in disposable cups requiring a cup lid. A consumer is able to place the cup lid assembly on the disposable cup. The detachable germ-free cover is able to be removed from the cup lid immediately prior to consuming the contents to preserve a germ-free environment on the cup lid thereby promoting healthful consumption. The cup lid is not exposed to germs until the detachable germ-free cover is removed from the top circumferential edge of the cup lid by using the pull tab to manipulate the detachable germ-free cover from a closed to an open position by peeling it back and away from the cup lid. While in use, the top surface of the cup lid is located above the bottom surface of the cup lid.

The present invention holds significant improvements and serves as a germ-free beverage lid system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, germ-free beverage lid system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a beverage cup lid device and more particularly to a germ-free beverage lid system as used to improve the ability for a consumer to have a germ-free lid for a disposable cup.

Generally speaking, many retail outlets such as fast food restaurants, hospital cafeterias, and convenience stores associated with gas stations sell beverages in disposable cups with a cup lid. In some cases the vendor places a lid on the disposable cup and in other cases a consumer may fill a disposable cup with a beverage and retrieve a cup lid from a stack of lids that are stored in an open environment subject to environmental problems such as germs, bacteria, dust, and other consumers touching the cup lid and replacing it to the stack they retrieved it from. In all of these circumstances the cup lid is especially susceptible to foreign particles and creates an unhealthy situation. These consumers would prefer to have access to a germ free cup lid such as the one described hereinafter.

Figure 1:
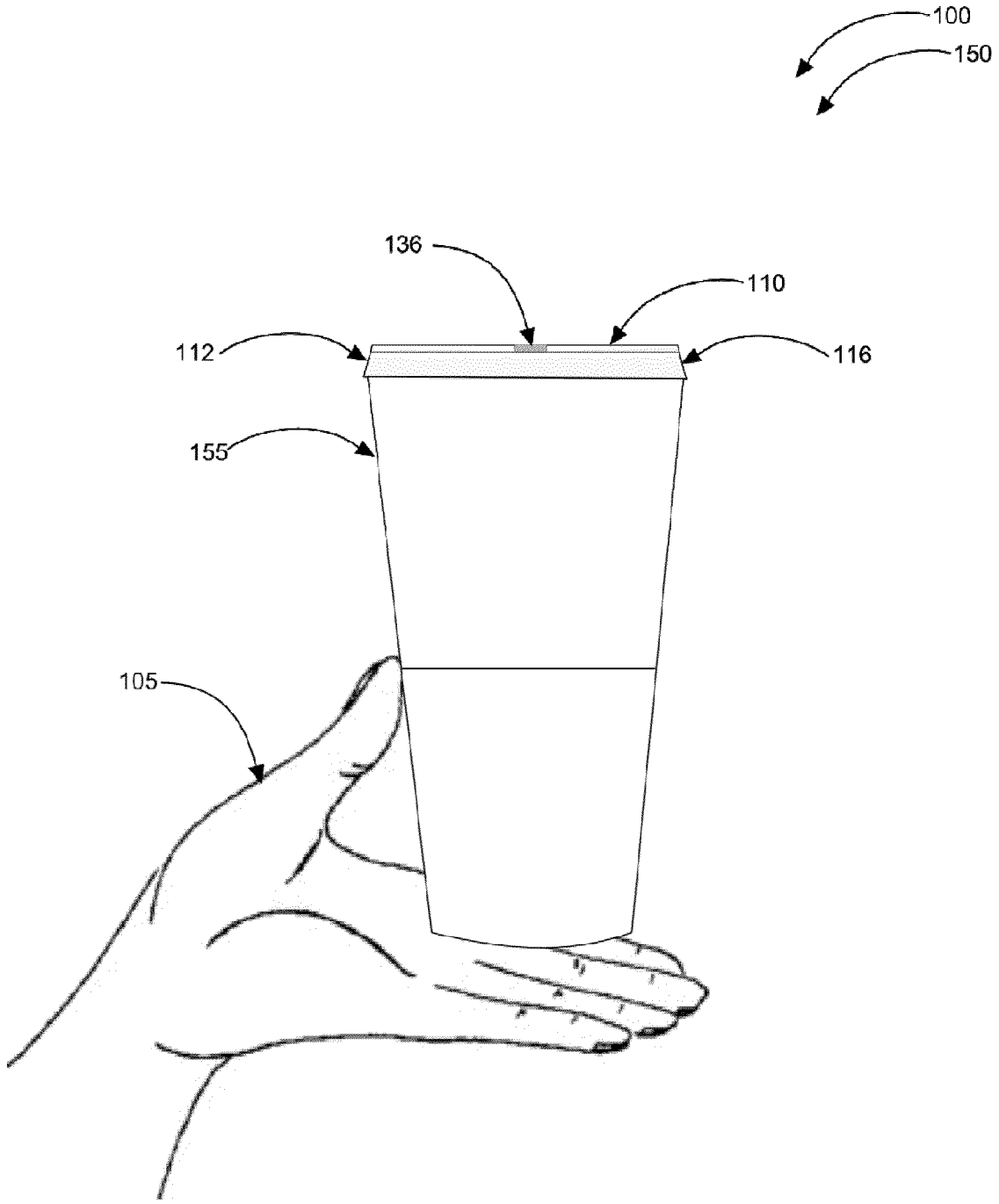
FIG. 1 shows a perspective view illustrating a germ-free beverage lid system in an in-use condition according to an embodiment of the present invention.

Referring now to the drawings by numerals of reference there is shown in FIG. 1 shows a perspective view illustrating germ-free beverage lid system 100 in an in-use condition 150 according to an embodiment of the present invention.

Germ-free beverage lid system 100 preferably comprises cup lid assembly 110 having cup lid 112 to frictionally and sealably fit about a circumference of drinking edge 158 of disposable cup 155, and detachable germ-free cover 130 for uncoupling from cup lid 112. Cup lid 112 comprises in combination lid-body 116, bottom circumferential edge 118 located on lid-body 116 with bottom circumferential edge 118 defining the outer limits of bottom surface 120 of cup lid 112 located adjacent disposable cup 155 when coupled thereto. Cup lid 112 further comprises top circumferential edge 122 (located on top surface 124 of cup lid 112 and a distance apart from bottom circumferential edge 118), and lid opening 126 allowing for drinking the contents of disposable cup 155 to occur. Lid opening 126 traverses bottom surface 120 and top surface 124 of cup lid 112 with top surface 124 providing a drinking access for consumer 105 to drink the contents of disposable cup 155 therefrom.

Figure 2:
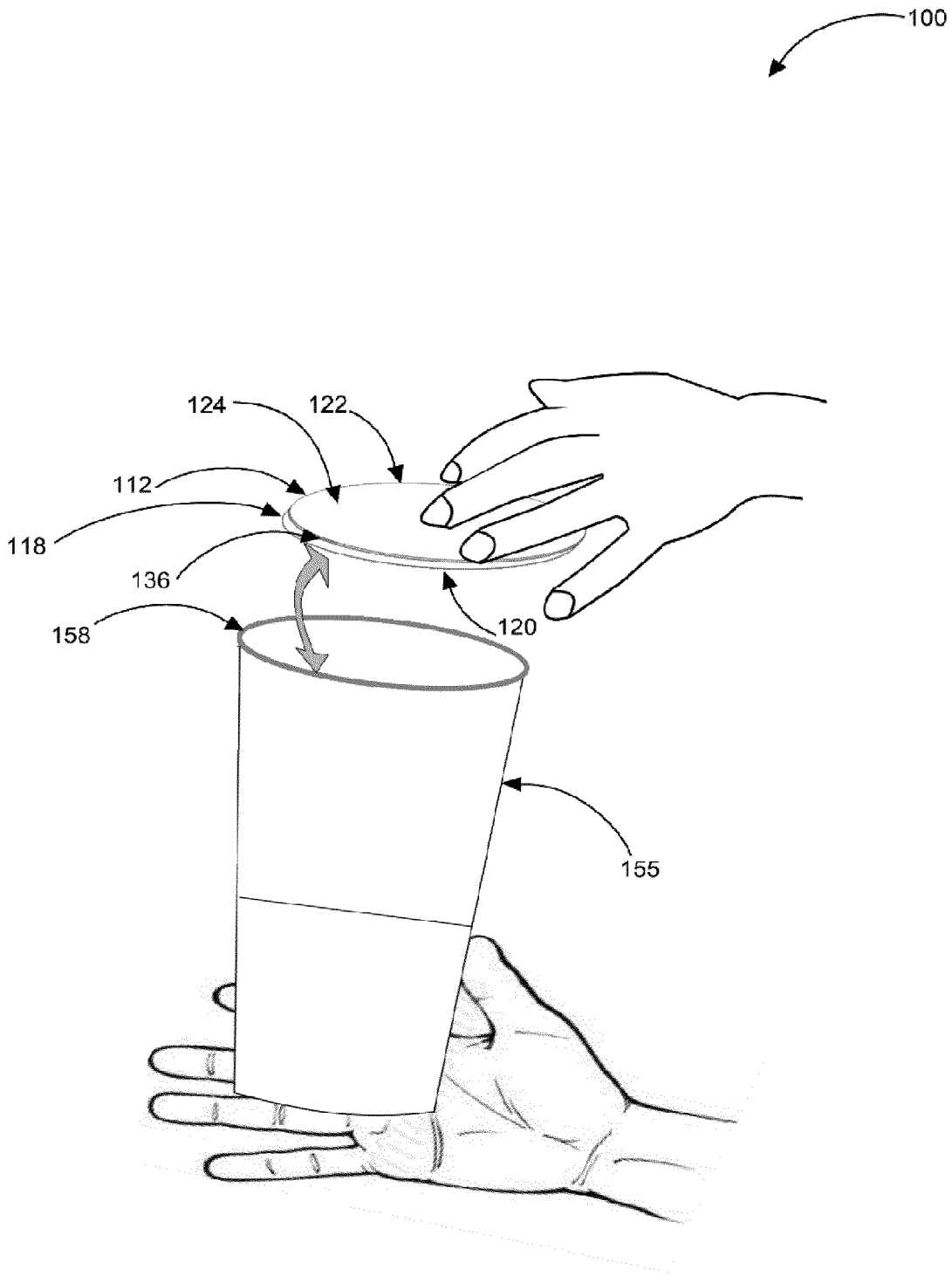
FIG. 2 is a perspective view illustrating a cup lid being placed on a disposable cup according to an embodiment of the present invention of FIG. 1.

Referring now to FIG. 2, a perspective view illustrating cup lid assembly 110 being placed on disposable cup 155 according to an embodiment of the present invention of FIG. 1.

Cup lid 112 is circular to fit onto drinking edge 158 of disposable cup 155 (in standard sizes) and represents a mouth contoured surface preferably comprised of BPA-free plastic to help contain the contents of disposable cup 155. BPA (BisphenolA) is an organic compound used to make polycarbonate plastic and epoxy resins along with other applications. In an alternate embodiment, cup lid 112 is paper material compressed and molded such that it is suitably rigid to hold its shape and maintain contents within confines of disposable cup 155. Cup lid 112 helps keep contents of disposable cup 155 at a desired temperature by resisting heat transfer through an evacuated zone—the zone between detachable germ-free cover 130 and top surface 124 before detachable germ-free cover 130 is removed for drinking from lid opening 126.

Figure 3:
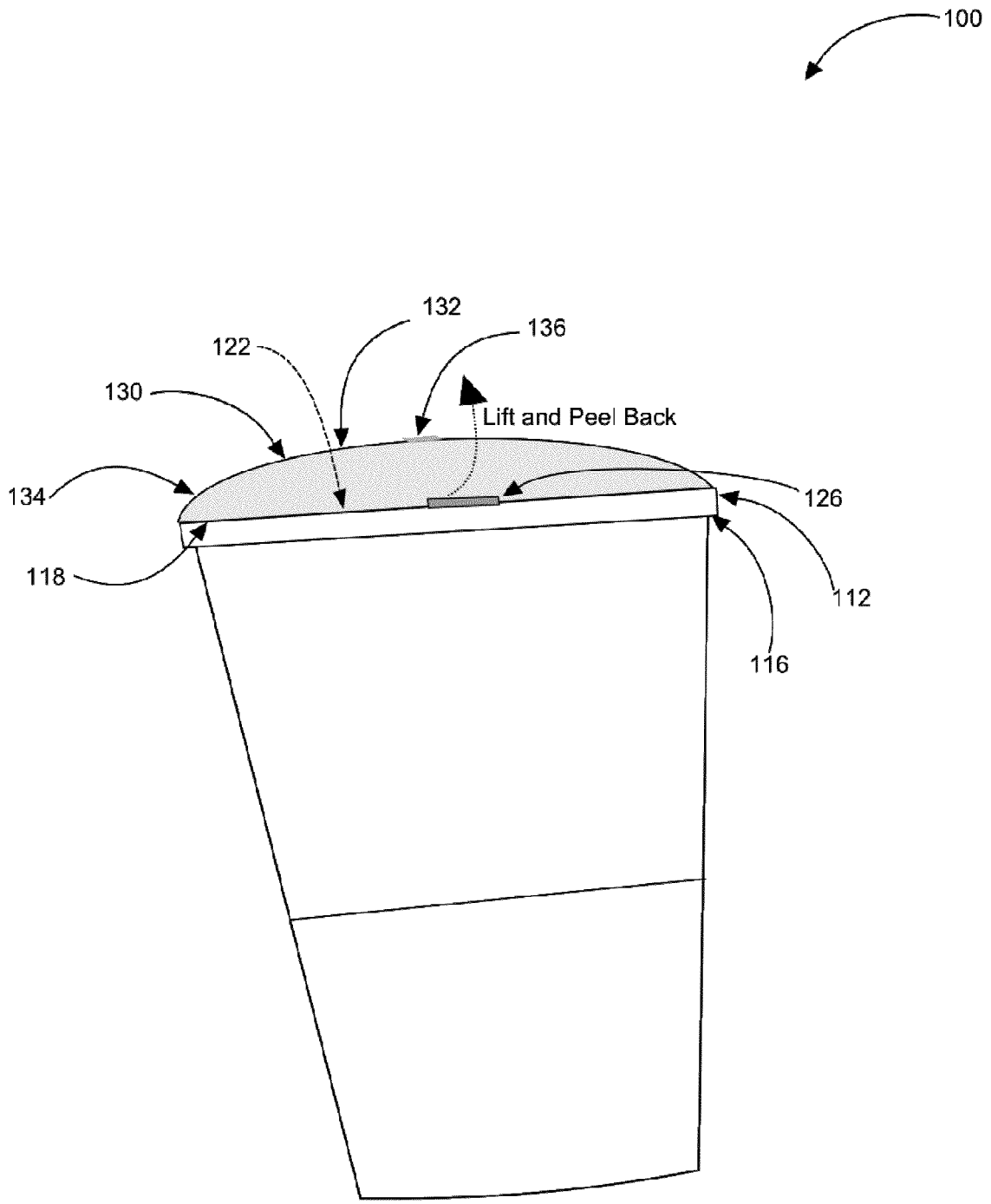
FIG. 3 is a perspective view illustrating a germ-free beverage lid system showing a detachable germ-free cover being removed from a cup lid according to an embodiment of the present invention of FIG. 1.

Referring now to FIG. 3 is a perspective view illustrating germ-free beverage lid system 100 showing detachable germ-free cover 130 being removed from cup lid 112 according to an embodiment of the present invention of FIG. 1.

Detachable germ-free cover 130 comprises in combination pliable surface 132 to cover top surface 124 of lid-body 116 of cup lid 112, an attaching edge 134 removably attached to top circumferential edge 122 of cup lid 112, and pull tab 136 (as shown in FIG. 1). Detachable germ-free cover 130 of cup lid assembly 110 is preferably removably attached to cup lid 112 via pressure when manufactured or alternately may be temporarily affixed using adhesive. Detachable germ-free cover 130 covers lid opening 126 of cup lid 112 maintaining a sterile environment for cup lid 112 creating a closed and evacuated zone to prevent germs from entering the contents of disposable cup 155 until after detachable germ-free cover 130 is removed from cup lid 112.

Detachable germ-free cover 130 comprises a thin profile to provide pliability and flexibility when peeling back and removing detachable germ-free cover 130 from cup lid 112 by using a lifting force and a pulling force imparted thereon to remove detachable germ-free cover 130 from top circumferential edge 122 of cup lid 112. Detachable germ-free cover 130 covers lid opening 126 of cup lid 112 to prevent germs from entering the contents of disposable cup 155 until after detachable germ-free cover 130 is removed (peeled) from cup lid 112.

Prior to use, cup lid assembly 110 is stackable one on top of another such that they are convenient for use by retail venders, hospital cafeterias and consumers 105 at self-serve locations providing hot and cold beverages in disposable cups 155 requiring cup lid 112. Consumer 105 is able to place cup lid assembly 110 on disposable cup 155. Detachable germ-free cover 130 is able to be removed from cup lid 112 immediately prior to consuming the contents to preserve a germ-free environment on cup lid 112 thereby promoting healthful consumption. Cup lid 112 is not exposed to germs until detachable germ-free cover 130 is removed from top circumferential edge 122 of cup lid 112 by using pull tab 136 to manipulate detachable germ-free cover 130 from a closed to an open position by peeling it back and away from cup lid 112. While in use, top surface 124 of cup lid 112 is located above bottom surface 120 of cup lid 112.

Figure 4:
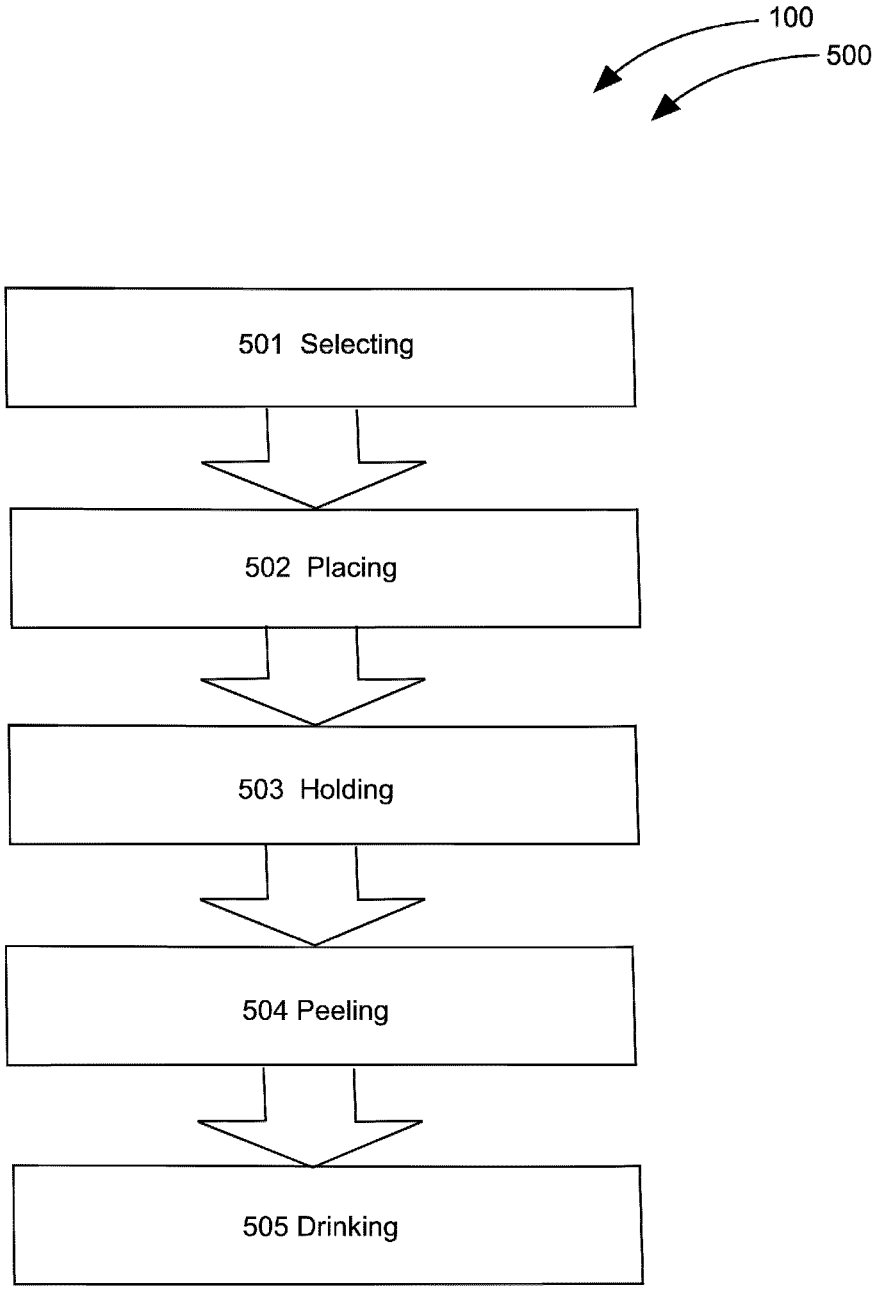
FIG. 4 is a flowchart illustrating a method of use of the germ-free beverage lid system according to an embodiment of the present invention of FIGS. 1-3.

Referring now to FIG. 4 is a flowchart illustrating method of use 150 of germ-free beverage lid system 100 according to an embodiment of the present invention of FIGS. 1-3.

Method of use 150 for germ-free beverage lid system 100 preferably comprises the steps of step one 501 selecting cup lid assembly 110 for use; step two 502 placing cup lid assembly 110 on disposable cup 155; step three 503 holding pull tab 136 of cup lid assembly 110; step four 504 peeling detachable germ-free cover 130 from cup lid 122 using pull tab 136; and step five 505 drinking contents of disposable cup 155.

The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A germ-free beverage lid system comprising:

a cup lid assembly comprising;

a cup lid to frictionally and sealably fit about a circumference of a drinking edge of a disposable cup comprising;

a lid-body;

a bottom circumferential edge located on said lid-body, said bottom circumferential edge defining outer limits of a bottom surface of said cup lid, said bottom surface located adjacent said disposable cup when coupled thereto;

a top circumferential edge located on a top surface of said cup lid; and a lid opening for drinking contents of said disposable cup, said lid opening traversing said bottom surface and said top surface, said top surface providing a drinking access for a consumer to drink contents of said disposable cup therefrom;

a detachable germ-free cover for uncoupling from said cup lid comprising;

a pliable surface to cover said top surface of said lid-body of said cup lid; and an attaching edge removably attached to said top circumferential edge of said cup lid; and a pull tab;

wherein said cup lid assembly comprises in combination said cup lid and said detachable germ-free cover, and said pull tab;

wherein said top circumferential edge is located above and a distance apart from said bottom circumferential edge;

wherein said top surface is located above said bottom surface during use;

wherein said cup lid helps contain said contents of said disposable cup;

wherein said detachable germ-free cover comprising in combination said pliable surface to cover said lid surface of said cup lid and said attaching edge removably attached to said top circumferential edge of said cup lid; and wherein a consumer is able to place said cup lid assembly on said disposable cup, said detachable germ-free cover is able to be removed from said cup lid immediately prior to consuming said contents to preserve a germ-free environment on said cup lid thereby promoting healthful consumption.

2. The germ-free beverage lid system of claim 1 wherein said cup lid assembly is circular to fit onto said drinking edge of said disposable cup.

3. The germ-free beverage lid system of claim 2 wherein said detachable germ-free cover of said cup lid assembly is removably attached to said cup lid when manufactured, said detachable germ-free cover installed thereon via pressure.

4. The germ-free beverage lid system of claim 2 wherein said detachable germ-free cover of said cup lid assembly prevents germs from attaching to said cup lid by maintaining a closed and evacuated zone.

5. The germ-free beverage lid system of claim 4 wherein said detachable germ-free cover comprises a thin profile to provide pliability and flexibility when peeling back and removing said detachable germ-free cover from said cup lid.

6. The germ-free beverage lid system of claim 4 wherein said cup lid is BPA-free plastic.

7. The germ-free beverage lid system of claim 1 wherein said cup lid is paper material.

8. The germ-free beverage lid system of claim 7 wherein said cup lid is comprised of compressed said paper material molded such that it is suitably rigid to hold its shape and maintain said contents within confines of said disposable cup without losing said shape.

9. The germ-free beverage lid system of claim 6 wherein said cup lid is not exposed to germs until said detachable germ-free cover is removed from said top circumferential edge of said cup lid.

10. The germ-free beverage lid system of claim 4 wherein said detachable germ-free cover covers said lid opening of said cup lid to prevents said germs from entering said contents of said disposable cup until after said detachable germ-free cover is removed from said cup lid.

11. The germ-free beverage lid system of claim 9 wherein said cup lid helps keep said contents of said disposable cup at a desired temperature by resisting heat transfer through said evacuated zone.

12. The germ-free beverage lid system of claim 10 wherein said detachable germ-free cover requires lifting force and pulling force imparted thereon to remove said detachable germ-free cover from said top circumferential edge of said cup lid.

13. The germ-free beverage lid system of claim 12 wherein said detachable germ-free cover maintains a sterile environment for said cup lid.

14. The germ-free beverage lid system of claim 1 wherein said germ-free beverage lid system is stackable such that it is convenient for use by retail venders.

15. The germ-free beverage lid system of claim 1 wherein said germ-free beverage lid system is useful with contents when said contents comprise hot beverages.

16. The germ-free beverage lid system of claim 1 wherein said germ-free beverage lid system is useful with contents when said contents comprise cold beverages.

17. A germ-free beverage lid system comprising:

a cup lid assembly comprising;

a cup lid to frictionally and sealably fit about a circumference of a drinking edge of a disposable cup comprising;

a lid-body;

a bottom circumferential edge located on said lid-body, said bottom circumferential edge defining outer limits of a bottom surface of said cup lid, said bottom surface located adjacent said disposable cup when coupled thereto;

a top circumferential edge located on a top surface of said cup lid; and a lid opening allowing for drinking contents of said disposable cup to occur, said lid opening traversing said bottom surface and said top surface, said top surface providing a drinking access for a consumer to drink contents of said disposable cup therefrom;

a detachable germ-free cover for uncoupling from said cup lid comprising;

a pliable surface to cover said top surface of said lid-body of said cup lid; and an attaching edge removably attached to said top circumferential edge of said cup lid by an adhesive; and a pull tab;

wherein said cup lid assembly comprises in combination said cup lid and said detachable germ-free cover, and said pull tab, said pull tab able to manipulate said detachable germ-free cover from closed to open for peeling;

wherein said top circumferential edge is located above and is a distance apart from said bottom circumferential edge;

wherein said top surface is located above said bottom surface during use; wherein said cup lid helps contain said contents of said disposable cup; wherein said cup lid is a mouth contoured surface; wherein said cup lid is BPA-free plastic;

wherein said cup lid helps keep contents of said disposable cup at a desired temperature by resisting heat transfer through an evacuated zone;

wherein said germ-free beverage lid system is useful with said contents when said contents comprise hot beverages;

wherein said germ-free beverage lid system is useful with said contents when said contents comprise cold beverages;

wherein said cup lid assembly is circular to fit onto said drinking edge of said disposable cup;

wherein said cup lid is not exposed to germs until said detachable germ-free cover is removed from said top circumferential edge of said cup lid;

wherein said detachable germ-free cover comprising in combination said pliable surface to cover said lid surface of said cup lid and said attaching edge removably attached to said top circumferential edge of said cup lid;

wherein said detachable germ-free cover maintains a sterile environment for said cup lid;

wherein said detachable germ-free cover of said cup lid assembly is removably attached to said cup lid when manufactured, said detachable germ-free cover installed thereon via pressure;

wherein said detachable germ-free cover covers said lid opening of said cup lid to prevents said germs from entering said contents of said disposable cup until after said detachable germ-free cover is removed from said cup lid;

wherein said detachable germ-free cover comprises a thin profile to provide pliability and flexibility when peeling back and removing said detachable germ-free cover from said cup lid;

wherein said detachable germ-free cover requires lifting force and pulling force imparted thereon to remove said detachable germ-free cover from said top circumferential edge of said cup lid;

wherein said detachable germ-free cover of said cup lid assembly prevents germs from attaching to said cup lid by maintaining a closed and said evacuated zone;

wherein said detachable germ-free cover covers said lid opening of said cup lid to prevents said germs from entering said contents of said disposable cup until after said detachable germ-free cover is removed from said cup lid;

wherein said germ-free beverage lid system is stackable such that it is convenient for use by retail venders and hospitals; and wherein a consumer is able to place said cup lid assembly on said disposable cup, said detachable germ-free cover is able to be removed from said cup lid immediately prior to consuming said contents to preserve a germ-free environment on said cup lid thereby promoting healthful consumption.

* * * * *